US007874942B2

(12) United States Patent
Auzoux et al.

(10) Patent No.: US 7,874,942 B2
(45) Date of Patent: Jan. 25, 2011

(54) BALL TOSS TOY

(75) Inventors: Yann O. Auzoux, 1715 15th St., NW., Suite 11, Washington, DC (US) 20009; Manmeet Kaur Jonsson, New York, NY (US); Paul Dowd, Scarsdale, NY (US); Robert Victor, Sunnyside, NY (US)

(73) Assignee: Yann O. Auzoux, Washington, DC (US)

( * ) Notice: Subject to any disclaimer, the term of this patent is extended or adjusted under 35 U.S.C. 154(b) by 169 days.

(21) Appl. No.: 12/289,179

(22) Filed: Oct. 22, 2008

(65) Prior Publication Data

US 2010/0099520 A1 Apr. 22, 2010

(51) Int. Cl.
*A63B 69/00* (2006.01)

(52) U.S. Cl. ..... 473/418; 473/417

(58) Field of Classification Search ..... 473/417–419, 473/422, 451; 40/406
See application file for complete search history.

(56) References Cited

U.S. PATENT DOCUMENTS 2,911,745 A * 11/1959 Valentine ..... 40/407
3,080,859 A 3/1963 Benkoe
3,612,027 A 10/1971 Makino
3,856,300 A 12/1974 Payne
4,136,869 A * 1/1979 Tassone ..... 473/417
4,402,507 A 9/1983 Hudson
4,564,195 A 1/1986 McClure et al.
4,575,080 A 3/1986 Miles
4,709,924 A 12/1987 Wilson et al.
4,858,921 A 8/1989 Eustice et al.
4,865,318 A 9/1989 Lehmann et al.
4,907,802 A 3/1990 Gatin
4,989,356 A * 2/1991 Combs ..... 40/584
5,011,144 A 4/1991 Marello et al.
5,115,794 A 5/1992 Moormann
5,160,131 A 11/1992 Leon
5,174,580 A 12/1992 Pratt
5,257,615 A 11/1993 Jones
5,294,109 A 3/1994 Meade
5,496,025 A 3/1996 Phillips et al.
5,507,271 A 4/1996 Actor
5,590,876 A 1/1997 Sejnowski
5,733,209 A 3/1998 McIntyre, IV
5,746,670 A 5/1998 Brady
5,794,364 A * 8/1998 Richmond ..... 40/406
5,823,894 A 10/1998 Actor
6,099,417 A * 8/2000 Brown et al. ..... 473/417
6,167,878 B1 1/2001 Nickerson et al.
6,186,857 B1 * 2/2001 Gazit et al. ..... 40/406

(Continued)

*Primary Examiner*—Mitra Aryanpour
(74) *Attorney, Agent, or Firm*—Buchanan Ingersoll & Rooney PC

(57) ABSTRACT

A portable lightweight ball toss toy comprises a tube, a wind sock and an air supply adapted to direct air through the tube and support a ball in a hover mode at an open end of the wind sock. The toy can include a ball supply adapted to hold at least one ball, a controller adapted to control the air supply to propel the ball from the open end of the tube in various modes including (a) a hover mode in which the ball hovers at the open end of the wind sock, (b) a toss mode in which the ball is propelled vertically out of the tube by one or more distances and/or (c) a pitch mode in which a ball is lobbed in a horizontal direction.

18 Claims, 1 Drawing Sheet

U.S. PATENT DOCUMENTS

| | | | | |
|---|---|---|---|---|
| 6,539,931 | B2 | 4/2003 | Trajkovic et al. | |
| 6,666,776 | B2 | 12/2003 | Yamaguchi | |
| 6,684,872 | B2 | 2/2004 | Kao et al. | |
| 6,804,905 | B1 * | 10/2004 | Burger et al. | 40/610 |
| 7,156,761 | B2 | 1/2007 | Mesa | |
| 7,252,595 | B2 | 8/2007 | Regev | |
| 7,294,071 | B1 | 11/2007 | Saumell | |
| 2002/0198068 | A1 * | 12/2002 | Jordan | 473/418 |
| 2008/0009373 | A1 * | 1/2008 | Binder et al. | 473/418 |
| 2009/0038480 | A1 * | 2/2009 | Garman et al. | 96/414 |

* cited by examiner

BALL TOSS TOY

FIELD OF THE INVENTION

The invention relates to an amusement device for young children

SUMMARY

A toy useful for amusement of young children comprises a tube adapted to direct air towards an open end of the tube, a wind sock extending from the open end of the tube and an air supply adapted to flow pressurized air through the tube and support a ball in a hover mode beyond the open end of the wind sock.

BRIEF DESCRIPTION OF THE DRAWING FIGURES

DETAILED DESCRIPTION

Figure 1:
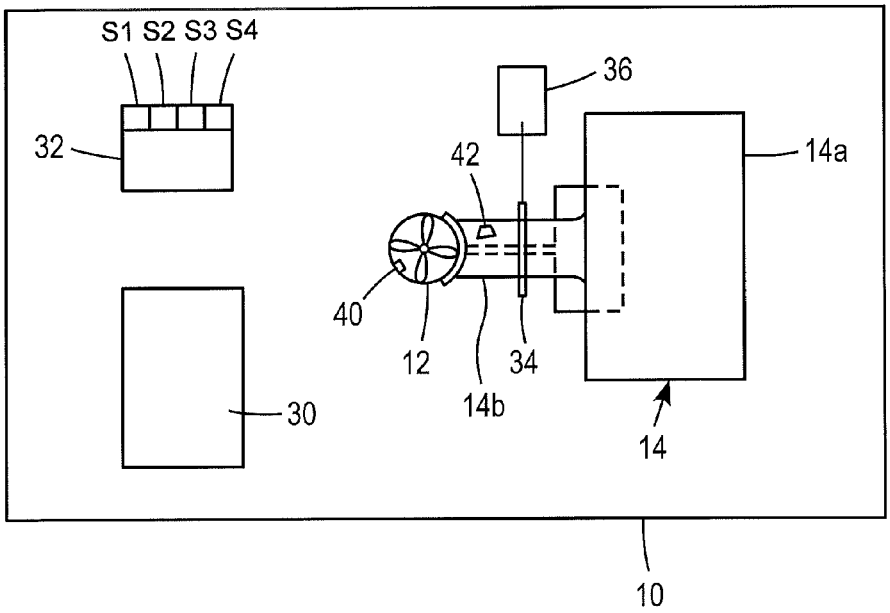
FIG. 1 is a top view showing a general layout of various parts of a ball toss toy in accordance with an embodiment.

In a first embodiment, a toy useful for amusement of young children comprises a tube adapted to direct air towards an open end of the tube, a wind sock extending from the open end of the tube and an air supply adapted to flow pressurized air through the tube and support a ball in a hover mode beyond the open end of the wind sock In a second embodiment, the ball toss toy described herein can be set in different modes and uses an air stream to allow a child to propel a ball under various conditions. For instance, in a hover mode, the toy utilizes a flexible air conduit (wind sock) to confine an air stream and suspend (hover) a ball in air at a position suitable for the child to watch the ball suspended in air or swing a ball striking implement such as a bat or racquet horizontally and strike the ball. In a toss mode, the toy can be used to propel a ball vertically to different heights including a height between the waist and shoulders or above the head to simulate a toss used in tennis and thus allow the child to swing vertically to serve a ball. In a pitch mode, the toy can be oriented to propel a ball towards the child such that the child can swing horizontally and strike the moving ball as in hitting a pitch or returning a shot in tennis or the child can develop catching skills by catching the ball with or without a glove.

In the second embodiment, the toy includes an air supply and a tube which receives a ball to be propelled through an open end of the tube by an air stream. The tube is preferably a linear piece of rigid tubing such as high impact polystyrene, polyvinylchloride (PVC) or the like. The toy can be made to operate with a ball having a particular size and weight or it can be made to operate with balls of different materials and having various weights. For example, the balls can be hollow plastic balls, plastic hard Styrofoam balls, rubber balls, soft foam balls, tennis balls, baseballs or the like. To add enjoyment in use of the toy, the balls can include light reflecting coloring and the tube through which the ball is propelled can include lighting which illuminates the ball in a manner which activates the colored light. Depending on the weight and size of the balls, the tube's inner diameter is slightly larger than the ball diameter and the air supply provides an airflow volume and speed sufficient to propel the ball to a desired vertical height or at a desired speed in an angled direction.

A wind sock such as tubular sleeve of woven or nonwoven fabric, plastic film or rubber membrane is attached to the open end of the tube for purposes of confining the air stream and supporting the ball slightly above the outlet end of the sleeve in the hover mode. A child can swing at the ball without damaging the tube since the fabric sleeve (such as a woven nylon sleeve) will deflect when it is struck with a bat or racquet. The sleeve preferably has a length which extends from the tube sufficiently (e.g., 6 to 12 inches) to allow a child to hit the ball and sleeve during a swing without hitting the tube. Whether or not the ball is struck by the child, the sleeve returns to a tubular configuration due to the flow of air therethrough. The air speed can be controlled to propel a ball upward through the tube and sleeve and maintain the ball in a stationary position so as to be suspended in air (hover) slightly above the outlet of the sleeve. In the hover mode, there is some back pressure in the tube and an optional pressure sensor can be used to sense changes in air pressure in the tube which occur when the ball is struck. The pressure sensor can send a signal to a controller which shuts off the air supply or actuates a ball feeder to load another ball in the tube for repeating the sequence.

The toy can be used for amusement or training. For instance, the toy can be used to levitate a ball on a cushion of air for amusement of the child or a child learning baseball, tennis, racquet ball or the like can use a bat, paddle or racquet to strike the ball with various types of swings. The toy described herein can be set up with the tube oriented vertically and the air supply adjusted to maintain the ball at a given height above the tube which allows the child to use different swings to drive the ball in various directions and impart the ball with various spins. Once the child learns how to execute the various swings, the child can transfer the perfected swings to moving balls such as thrown balls or balls struck by paddles or racquets. In the toss and pitch modes, the air supply can be adjusted to propel the ball to various heights to enable the child to learn how to hit balls moving vertically and/or horizontally, e.g., vertically overhead to allow the child to develop a service motion. Thus, instead of learning how to toss the ball and swing at the tossed ball, the child can work on a service motion which directs the ball in a desired direction and with various types of ball spin depending on how the service motion is executed. Once the child perfects the service motion, the child can then learn the ball toss with greater confidence and greater skill than in the case where the child must learn both at the same time.

The toy can also include a tilt mechanism to angle the tube at an angle effective to propel balls toward a child to simulate a thrown pitch or hit ball as in tennis, racquet ball or paddle ball. The air supply can be adjusted to control the speed of the ball at a desired velocity to allow striking the ball with or without bouncing before being struck.

In the embodiment shown in FIG. 1, the toy includes an adjustable base 10, a tube 12 extending upwardly from the base, a ball supply 14 adapted to deliver a ball 16 through an inlet 18 in the side of the tube, an adjustable speed motor 20, a shaft 22 connected to the motor, a fan 24 connected to the shaft and located in the bottom of the tube, and a flexible wind sock 26 attached to the upper end of the tube. Air enters the tube through an open lower end of the tube and is driven by the fan out the upper end of the tube. However, other air supplies can be used such as an air compressor or different fan arrangement. The ball supply can be a V-shaped ramp 14*a* and optional hopper 14*b* arranged to deliver a ball 16 such that it drops into the tube 12 at a lower end thereof and due to the force of air blown by the fan 24, the ball 16 is propelled up the tube.

Figure 2:
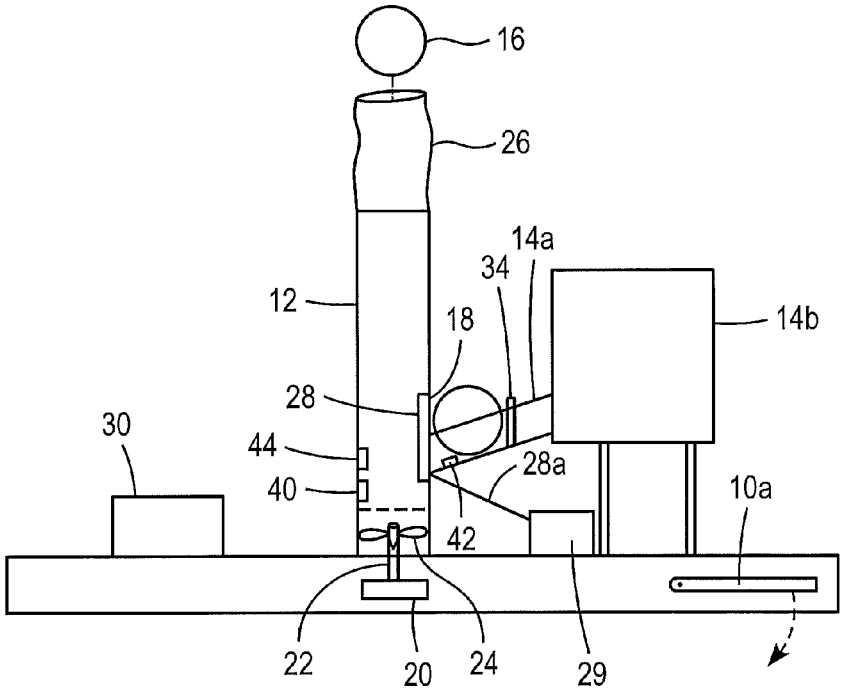
FIG. 2 is a side view of the ball toss toy shown in FIG. 1.

In the hover (TEE) mode, the ball is propelled through the sock 26 until reaching a height at which the air stream exiting the wind sock supports the ball 16 on a cushion of air slightly above the open end of the wind sock 26, as shown in FIG. 2. The tube 12 can include a movable door 28 which prevents the ball 16 from entering the tube 12 until the door is moved mechanically by actuation of a mechanism such as a foot switch or electrically by actuation of an electrical mechanism such as a manually or voice activated electrical switch. The wind sock 26 has a length suitable to allow a bat or racquet to be swung at the ball without hitting the tube, i.e., the wind sock will deflect if the child swings below the ball with a bat or swings through the ball location with a racquet. A battery 30 (e.g., battery pack of rechargeable or non-rechargeable batteries such as AA, C or D cell batteries) supplies power to the fan and a controller 32 such as a microprocessor or the like operates the fan and ball supply. Alternatively, the fan can be operated by AC current supplied by an electrical outlet and/or the controller can be omitted such as in the case of manual operation of the toy.

The toy can be used in a toss mode where the ball 16 is propelled to various heights suitable to be struck by a racquet during a ground stroke, batting swing or service motion. In the toss mode, the air supply can propel the ball to a sufficient height above the waist of a child. The ball can be fed through a door which opens upon mechanical or electrical actuation. To simulate different ball tosses, the base can be tilted to orient the tube at an angle so that the ball is propelled from in front of the child to a desired location such as directly over the child's head, slightly in front of the child's head, slightly behind the child's head, or at the same locations but to the child's right or left.

In the pitch mode, the toy can be used to lob a ball vertically and horizontally to simulate a thrown pitch or ball return in tennis. For toys in which the tube is fixed to the base in a vertical orientation, the base can include a tilt mechanism to allow the base to be tilted sufficiently to orient the tube in a non-vertical orientation at any suitable angle such as an angle of 30 to 60 degrees with respect to the ground. For example, the base can include a tilt mechanism 10*a* pivotally attached at one end of the base to allow that end to be raised to one or more heights relative to the opposite end of the base whereby the tube can be oriented at a desired non-vertical orientation to lob balls towards a child. Alternatively, the tube can be mounted in a manner which allows the tube to be angled with respect to the base.

In an embodiment, the toy is lightweight and when used with lightweight balls (such as foam balls with a diameter of 1 to 3 inches), the toy can be used indoors such as in a family room or basement. The ball can be gently tossed by air generated with a battery operated fan making operation of the machine safe for small children. The battery operated fan allows children to use the toy without adult supervision and due to the quiet operation of the fan, the toy can be operated without offending other persons in the vicinity of the toy.

In the embodiment including a ball supply, the balls can be loaded in a basket 14*b* or other receptacle and fed to the tube by a ramp 14*a* or other suitable ball feeding arrangement. Entrance to the tube is preferably blocked by a movable door 28 which can be actuated mechanically as by a foot pedal or electronically such as by a timer circuit or switch. For example, the door can be a section of tubing sized to overlie the opening in the tube and slidably mounted to move axially or circumferentially to open and close the opening. To bias the door in a closed position, a spring could be used to return the door to the closed position after each actuation. Alternatively, if the door is arranged to move vertically in an upward direction, the weight of the door or an added weight could be used to return the door to the closed position. To move the door 28 to the open position, a movable arm 28*a* attached to the door 28 and actuated by a motor or solenoid 29 can be used to move the door to the open position and thereby allow the ball closest to the tube to fall under its weight into the tube after which the fan generates the air stream to the ball or if the fan has already been actuated the suction created by the air stream in the tube can be used to pull the ball into the tube. Alternatively, the door can run along a vertical guide rail and a track rod hanging from the door can cooperate with a motor driven gear to raise and lower the door automatically by a microprocessor. The balls are stored such that they are fed one at a time to the tube. For example, the balls can travel down an inclined ramp and a movable partition 34 actuated by a motor or solenoid 36 can be used to separate the two balls closest to the tube so that only the closest ball can enter the tube when the door is opened. Alternatively, the partition can be omitted by adjusting the angle of the ramp such that only one ball rolls into the tube before the door closes. If desired, suction force generated by the air stream traveling through the tube can be used to pull a ball into the tube when the door is opened after which the door is shut as the ball is propelled upwardly through the tube. In another embodiment, the fan is not activated until after a ball enters the tube and the door is closed.

The toy can be used with lightweight balls having a weight of 1.5 ounce and diameter of 2.85 inch or with tennis balls having a weight of 2.7 ounce and diameter of 2.45 inch. The tube can be sized for a particular diameter ball or tubular inserts can be used to vary the diameter of the tube to accommodate different size balls. For example, if a 1.5 inch ball is used and the tube has an inner diameter of 3 inches, a tubular insert having an inner diameter slightly larger than 1.5 inches can be fitted in the tube. For tennis balls having a diameter of 2.45 inches, a tubular insert having an inner diameter of slightly larger than 2.45 inches can be fitted in the tube. To adjust the length of the tube, the tube can include telescoping sections to raise or lower the upper end of the tube.

To accommodate children of different heights, the tube can be telescopic or the wind sock can be attached to the tube such that the length of the wind sock above the outlet end of the tube is at a desired location. For example, the wind sock can be attached to the tube with an elastic band and the lower end of the wind sock can be moved vertically along the tube until the outlet end of the wind sock is at a desired location above the outlet end of the tube. Alternatively, wind socks can be provided with different lengths and a wind sock of suitable length can be used to achieve the location above the outlet end of the tube at which the air propelled ball will be supported on a cushion of air.

In the embodiment having a controller (control box), the controller 32 can cooperate with various sensors and switches. For example, the controller can receive signals from a sensor 40 (such as a pressure sensor or light sensor) in the tube to monitor when a ball has been struck after being in the hover mode. Another sensor 42 can be used to detect when the ball supply runs out of balls. The sensor 42 can also be used to detect the presence of a ball to be loaded into the tube, i.e., the controller can be programmed to not open the door unless a ball is detected on the ramp. In order to control operation of the toy and direct the air supply to propel the balls in the various modes, the controller can incorporate or cooperate with one or more switches. For example, the one or more switches can include a first switch S1 controlling on/off operation of the toy, a second switch S2 controlling start of the ball feeding by the ball supply, a third switch S3 controlling ball mode wherein the air supply is adjusted to propel a ball to the hover, toss or pitch mode, and a fourth switch S4 controlling ball feed mode between single feed mode wherein a single ball is propelled out of the tube or multi-feed mode wherein balls are repetitively propelled out of the tube at timed intervals.

In a preferred embodiment, the controller can be programmed to load and propel a ball to various heights out of the tube depending on the position of a selector switch arrangement. For example, a control box can include various switches such as a mode selector switch movable to a TEE mode position or a PITCH mode position and start button acting as an on-off switch to initiate a ball loading and propelling cycle. Another switch movable to a single ball or repeat ball mode position can be used for single ball actuation or multiple ball actuation of the toy.

The tube can optionally include illumination to provide additional enjoyment to children. For example, one or more light sources 44 such as light diodes can be located inside the tube and/or below the bottom opening in the tube for purposes of illuminating a ball as it is propelled out of the tube. To augment the effect of the light source 44, the balls can be translucent or include reflective and/or fluorescent material to provide different visual effects. For instance, the light source can emit a blue beam of light which is directed outwardly of the wind sock to illuminate a ball as it hovers on a cushion of air.

The following describes a preferred embodiment of the ball toss toy. However, various changes and modifications can be made to this embodiment if desired.

The ball toss toy can be operated electronically with a control box which has an ON/OFF switch at the top of the box. When not in use the ON/OFF switch should be put in the OFF mode. An "AA" pack can be used for a microprocessor contained in the box. When the power is first applied, the electronics checks to see if the door is closed. If the door is not closed, the electronics will close the door. If the door is open when the START switch is pressed, the door will be closed and the START switch must be pressed again to start the sequence.

The START button starts the sequence. The setting of the MODE switch (TEE or PITCH) will determine which sequence will be activated. For audible feedback, when pressed, the START switch will generate one beep. The sequence will start. Based on sensor feedback, the microprocessor will determine if a ball is ready to be loaded in the tube and if it is determined that no ball is present, three beeps will sound to indicate there is no ball in the hopper (load ramp). If this happens the sequence will not start until a ball is put on the hopper (ramp). The electronics has no way of sensing whether a ball is already in the tube. Thus, if a ball is in the tube and the START button is pressed, the sequence will not start. However, one or more additional sensors can be incorporated in the toy to detect a ball in the tube. Anytime during a sequence if the START button is pressed the unit will shut down and two beeps will sound from the speaker. If the door is open, it will be closed before power to the unit is shut down.

Above the START button is an input called TRIGGER. An external START switch can be connected using a ⅛" mono miniplug (stereo will also work). This will allow a foot pedal to be used for activating the unit. The regular START switch will still function. Below the ON/OFF (START button) are the MODE and REPEAT switches.

The MODE switch is labeled PITCH and TEE. When the slide switch is in the PITCH position the unit is in PITCH mode. When the slide switch is towards the TEE side the unit is in the TEE mode.

The SINGLE and REPEAT mode works the same way. In the repeat mode one beep will be heard before each sequence starts.

On the right side of the base is the battery holder for the three "AA" cells used for the microprocessor. These "AA" batteries should last longer than the "D" cell batteries.

There are four cables coming out of the box. The motor cables have headers which are polarized differently. The wires to the switches use jacks that are designed to only connect in one way.

When power is turned ON, or the START button is pressed, the door is checked to make sure it is closed. If the door is not closed, the door motor will turn ON to close it. If the door switch does not detect the door closed in 4 seconds the motor will turn OFF. This protection is also applied to the door open function.

While particular embodiments of the invention have been shown in the drawings and described above, it should be understood that such embodiments are intended as illustrative and not intended to limit the scope of the claims appended hereto. Thus, variations and modifications may be made in form, construction and materials used, and the invention practiced otherwise than as specifically described herein, without departing from the scope of the claimed invention.

What is claimed is:

1. A ball toss toy useful for amusement of young children comprises:

a tube adapted to direct pressurized air towards an open end of the tube;

a wind sock attached to the tube and extending from the open end of the tube;

an air supply adapted to flow pressurized air through the tube and support a ball in a hover mode beyond the open end of the wind sock;

a ball supply and controller, the air supply comprising an adjustable speed fan located at a portion of the tube below an inlet in the tube through which a ball enters the tube from the ball supply, the controller controlling air speed of the fan to propel the ball through the tube to a selected first, second or third distance from the open end of the tube;

wherein the controller is adapted to control the air supply to propel the ball different distances from the open end of the tube, the distances including (a) a hover mode in which the ball hovers above the open end of the tube, (b) a toss mode in which a ball is ejected one or more distances vertically out of the tube and/or (c) a pitch mode in which a ball is lobbed in a horizontal direction.

2. The ball toss toy of claim 1, wherein the tube is fixedly mounted on a base, the base including a tilt mechanism which tilts the base to orient the tube in one or more non-vertical orientations.

3. The ball toss toy of claim 1, further comprising a battery supplying power to the air supply, the air supply comprising an adjustable speed fan.

4. The ball toss toy of claim 1 further comprising one or more switches adapted to control operation of the ball toss toy.

5. The ball toss toy of claim 4, wherein the switches include a first switch controlling on/off of the ball toss toy, a second switch controlling start of the ball feeding, a third switch controlling ball mode wherein a ball is propelled outward of the tube in either the hover mode, toss mode or pitch mode, and a fourth switch controlling ball feed wherein a single ball is propelled out of the tube or balls are repetitively propelled out of the tube at timed intervals.

6. The ball toss toy of claim 5, further comprising a time out timer wherein the ball toss toy is shut down after a set time period following propelling a ball in the hover mode.

7. The ball toss toy of claim 1, further comprising a light source directing light through the tube.

8. The ball toss toy of claim 7, wherein the light source projects one or more beams of colored light through the outlet end of the tube.

9. The ball toss toy of claim 7, wherein the light source comprises one or more light diodes.

10. The ball toss toy of claim 7, wherein the balls are translucent and the light source projects a beam of blue light through the outlet end of the tube.

11. The ball toss toy of claim 1, wherein the ball supply includes an inclined ramp which feeds balls to the tube, the tube including an inlet through which a ball enters the tube and falls until air flowing in the tube overcomes the weight of the ball and propels the ball out of the outlet end of the tube.

12. The ball toss toy of claim 11, further comprising a sensor which detects whether or not a ball is on the ramp.

13. A method of using the ball toss toy of claim 1, comprising setting up the ball toss toy with the tube in a vertical orientation, activating the air supply, maintaining the ball in the hover mode for at least a set time period, and automatically terminating supply of power to the air supply after the set time period.

14. A method of using the ball toss toy of claim 1, comprising setting up the ball toss toy with the tube in a substantially vertical orientation, activating the air supply, feeding balls to the tube and repetitively propelling the balls in the toss mode.

15. A method of using the ball toss toy of claim 1, comprising setting up the ball toss toy with the tube in a non-vertical orientation, activating the air supply, feeding balls to the tube and repetitively propelling the balls in the pitch mode.

16. A method of using the ball toss toy of claim 1, comprising illuminating an inside of the tube with a beam of colored light which is emitted from the outlet end of the wind stock, activating the air supply, maintaining a ball in the hover mode.

17. A ball toss toy useful for amusement of young children comprises:

a tube adapted to direct pressurized air towards an open end of the tube;

a wind sock attached to the tube and extending from the open end of the tube;

an air supply adapted to flow pressurized air through the tube and support a ball in a hover mode beyond the open end of the wind sock;

a ball supply and controller, the air supply comprising an adiustable speed fan located at a portion of the tube below an inlet in the tube through which a ball enters the tube from the ball supply, the controller controlling air speed of the fan to propel the ball through the tube to a selected first, second or third distance from the open end of the tube; and further comprising a movable door and an actuating mechanism, the door being movable from a closed position at which the door blocks the inlet to an open position at which a ball may pass through the inlet, the actuating mechanism being operable to move the door from the closed position to the open position.

18. A ball toss toy useful for amusement of young children comprises:

a tube adapted to direct pressurized air towards an open end of the tube;

a wind sock attached to the tube and extending from the open end of the tube;

an air supply adapted to flow pressurized air through the tube and support a ball in a hover mode beyond the open end of the wind sock; and further comprising a sensor which detects when a ball in the hover mode has been struck by a bat or racquet.

* * * * *